US006548119B1

(12) United States Patent
Siever et al.

(10) Patent No.: US 6,548,119 B1
(45) Date of Patent: Apr. 15, 2003

(54) PROCESS FOR PRODUCING TWO-LAYER AUTOMOTIVE COATS USING AN AQUEOUS BASE COAT

(75) Inventors: Ludwig Siever, Schwelm (DE); Peter Minko, Schwelm (DE); Holger Schmidt, Wuppertal (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/913,568

(22) PCT Filed: Feb. 11, 2000

(86) PCT No.: PCT/EP00/01132

§ 371 (c)(1),
(2), (4) Date: Aug. 13, 2001

(87) PCT Pub. No.: WO00/48748

PCT Pub. Date: Aug. 24, 2000

(30) Foreign Application Priority Data

Feb. 15, 1999 (DE) ..... 199 06 247

(51) Int. Cl.[7] ..... B05D 7/16; B05D 3/00
(52) U.S. Cl. ..... 427/407.1; 427/377
(58) Field of Search ..... 427/409, 407.1, 427/419.1, 419.2, 419.3, 372.2, 377, 385.5, 388.1

(56) References Cited

U.S. PATENT DOCUMENTS 4,558,090 A * 12/1985 Drexler et al. ..... 427/407.1
5,145,721 A 9/1992 Kojima et al.
5,168,105 A * 12/1992 Anderson, Jr. et al. ..... 524/441
5,236,995 A * 8/1993 Salatin et al. ..... 427/402
6,035,547 A * 3/2000 Hess et al. ..... 34/270

FOREIGN PATENT DOCUMENTS

| | | |
|---|---|---|
| DE | 19517277 C1 | 8/1996 |
| GB | 2233257 A | 1/1991 |
| WO | WO 9848946 | 11/1998 |

OTHER PUBLICATIONS

Environmental Data Sheet, PPG Industries, Inc., HWBS90394.*

Material Safety Data Sheet, PPG Industries, Inc., HWBS90394.*

* cited by examiner

*Primary Examiner*—Shrive P. Beck
*Assistant Examiner*—William Phillip Fletcher, III

(57) ABSTRACT

A process for producing a two-layer coat on a motor vehicle body in an automatic motor vehicle series lacquering unit. The process comprises the steps of applying an aqueous base lacquer coating composition to the motor vehicle body, exposing the aqueous base lacquer coating to a circulating air at 25 to 45° C. having an air throughout of 0.10 to 0.70 m/s for 30 to 180 seconds, applying a transparent finishing lacquer layer of a clear lacquer coating composition to the aqueous base lacquer layer, and baking the aqueous base lacquer and transparent finishing lacquer layer.

6 Claims, No Drawings

PROCESS FOR PRODUCING TWO-LAYER AUTOMOTIVE COATS USING AN AQUEOUS BASE COAT

FIELD OF THE INVENTION

The invention relates to a process for producing two-layer automotive top coats consisting of a base lacquer layer and a clear lacquer finishing layer.

BACKGROUND OF THE INVENTION

Two-layer automotive top coats are produced by wet-on-wet application of a transparent finishing lacquer layer to a colour- and/or effect-giving base lacquer layer that has been pre-dried by exposure to air. The colour- and/or effect-giving base lacquer layer is produced using either non-aqueous or aqueous base lacquers in the lacqering units of the individual motor vehicle manufacturers. Non-aqueous base lacquers contain organic solvents in an order of magnitude of, for example, from 55 to 80 wt. %, while aqueous base lacquers contain only, for example, from 10 to 25 wt. % organic solvents. For reasons of environmental protection, therefore, there is a trend towards replacing base lacquers based on organic solvents by aqueous base lacquers. For example, older lacquering units in which non-aqueous base lacquers are processed are being replaced by new lacquering units constructed for the processing of aqueous base lacquers.

The air-exposure conditions for base lacquer layers in lacquering units for the application of base lacquers based on organic solvents are different from those in lacquering units designed specifically for the application of water-borne lacquers. In lacquering units designed for the application of base lacquers based on organic solvents, the air-exposure conditions that prevail are characterised by short air-exposure times of, for example, from 30 to 180 seconds at air temperatures of, for example, from 20 to 30° C. Aqueous base lacquers require longer air-exposure times at higher air temperatures in order to obtain a pre-dried base lacquer film on completion of the air-exposure operation. In lacquering units for the application of aqueous base lacquers, therefore, the air-exposure times are, for example, from 5 to 10 minutes and the air temperatures prevailing during the exposure to air are higher at, for example, from 40 to 80° C. For example, for the purposes of adequate pre-drying suitable for the subsequent wet-on-wet application of a clear lacquer coating composition, coating layers applied from aqueous base lacquers are exposed to air first for from 1 to 2 minutes at from 20 to 40° C. and then for from 3 to 5 minutes using warm air of from 40 to 80° C. The short air-exposure times in lacquering units designed for the application of base lacquers based on organic solvents are the result of the only short overall length of the air-exposure region and the belt speed given by the production target of the vehicle body coating process. In the case of base lacquers based on organic solvents, such short air-exposure times are sufficient to obtain a pre-dried base lacquer film on completion of the air-exposure operation, but that is not the case with aqueous base lacquers. Accordingly, it is not possible to process aqueous base lacquers in lacquering units that allow only short air-exposure times.

SUMMARY OF THE INVENTION

The object of the invention is to provide a process for producing two-layer motor vehicle top coats by the wet-on-wet application of an aqueous base lacquer coating composition and a clear lacquer coating composition while allowing only short air-exposure times of, for example, from 30 to 180 seconds for the base lacquer layer. In particular, the process is to allow aqueous base lacquers to be processed in automated motor vehicle series lacquering units that are designed for the processing of non-aqueous base lacquers and allow only short air-exposure times for the base lacquer layers.

The object is achieved by observing the following conditions in the formulation of aqueous base lacquer coating compositions and observing the following process conditions during the exposure to air of the coating layers applied from such aqueous base lacquer coating compositions.

Accordingly, the invention provides a process for producing a two-layer colour- and/or effect-giving top coat on motor vehicle bodies in an automatic motor vehicle series lacquering unit, wherein a transparent finishing lacquer layer of a clear lacquer coating composition is applied to a base lacquer layer that has been applied from an aqueous colour- and/or effect-giving base lacquer coating composition and exposed to air, and the two coating layers are together baked, which process is characterised in that there is used an aqueous base lacquer coating composition that contains organic solvents according to a high solid value of from 40 to 70%, and the base lacquer layer, after it has been applied and before the transparent finishing lacquer layer is applied, is exposed to air for from 30 to 180 seconds using circulating air at from 25 to 45° C. with an air throughput of from 0.10 to 0.70 m/s, based on the area provided with the aqueous base lacquer layer.

DETAILED DESCRIPTION OF THE INVENTION

According to the invention, aqueous base lacquer coating compositions are used. For example, in addition to water they contain one or more conventional binders, organic solvents and pigments as well as, optionally, fillers, crosslinking agents, and/or additives conventionally employed in lacquers. The aqueous base lacquer coating compositions used in the process according to the invention have, for example, solids contents by weight of from 15 to 50 wt. %; for aqueous effect base lacquers that value is, for example, preferably from 15 to 30 wt. %, and for aqueous single coloured base lacquers it is preferably higher, for example from 20 to 45 wt. %. The solids content by weight of the aqueous base lacquer coating compositions is formed from the sum of the solids contents of the binders, pigments, fillers, crosslinking agents, and non-volatile additives conventionally employed in lacquers. The weight ratio of pigment to binder in the aqueous base lacquer coating composition is, for example, from 0.05:1 to 3:1; for aqueous effect base lacquers it is, for example, preferably from 0.1:1 to 0.6:1, and for aqueous single coloured base lacquers it is preferably higher, for example from 0.1:1 to 2.5:1, in each case based on the weight of the solids. When calculating the ratio of pigment to binder, the sum of the amounts by weight of colour-giving pigments, effect pigments and fillers is related to the sum of the amounts by weight of binder solids, paste resin solids and crosslinking agent solids in the finished aqueous base lacquer.

In addition to the air-exposure conditions for the base lacquer layer which are to be observed according to the invention and which are explained hereinbelow, it is essential to the invention that the aqueous base lacquer coating compositions used in the process according to the invention have a high solid value of from 40 to 70%. In the case of aqueous effect base lacquers, that value is, for example, from 40 to 60%, and in the case of aqueous single coloured base lacquers it is, for example, from 40 to 70%. The high solid value of the aqueous base lacquer coating compositions is calculated according to the formula $$\frac{\text{solids content in wt. \%} \times 100\%}{\text{solids content in wt. \%} + \text{content of organic solvents in wt. \%}}$$

The solvent content and the solids content are therefore to be so matched that a high solid value of from 40 to 70% is obtained according to the above formula.

The aqueous base lacquers used in the process according to the invention contain conventional ionically or non-ionically stabilised binder systems. Such systems are preferably anionically and/or non-ionically stabilised. Anionic stabilisation is preferably achieved by means of at least partially neutralised carboxyl groups in the binder, while non-ionic stabilisation is preferably achieved by means of lateral or terminal polyethylene oxide units in the binder. The aqueous base lacquers may be physically drying in nature or crosslinkable with formation of covalent bonds. Aqueous base lacquers that crosslink with formation of covalent bonds may be self-crosslinking systems or systems that crosslink by external means. In the latter case, the aqueous base lacquers may be single- or multi-component.

The aqueous base lacquers used in the process according to the invention contain one or more conventional film-forming binders. If the binders are not self-crosslinking or self-drying, they may optionally also contain crosslinking agents. Neither the binder component nor the crosslinking component that may optionally be present is subject to any limitations of any kind. There may be used as film-forming binders, for example, conventional polyester, polyurethane and/or poly(meth)acrylate resins. The choice of crosslinking agents that may optionally be present is not critical; it is dependent, in a manner known to those skilled in the art, on the functionality of the binders.

The aqueous base lacquers used in the process according to the invention contain colour- and/or effect-giving pigments and, optionally, fillers. Examples of colour-giving inorganic or organic pigments and fillers are titanium dioxide, micronised titanium dioxide, iron oxide pigments, carbon black, silicon dioxide, barium sulfate, micronised mica, talcum, kaolin, chalk, layered silicates, azo pigments, phthalocyanine pigments, quinacridone pigments, pyrrolopyrrole pigments, perylene pigments. Examples of effect-giving pigments are metal pigments, for example of aluminium, copper or other metals; interference pigments, such as, for example, metal-oxide-coated metal pigments, for example titanium-dioxide-coated aluminium, coated mica, such as, for example, titanium-dioxide-coated mica, graphite effect pigments, plate-like iron oxide, plate-like copper phthalocyanine pigments.

Effect pigments are generally used in the form of a commercial aqueous or non-aqueous paste; organic solvents and additives, preferably water-dilutable organic solvents and additives, are optionally added thereto, and the whole is then mixed with aqueous binder, with shearing. Powdered effect pigments may first be processed with preferably water-dilutable organic solvents and additives to form a paste.

Colouring pigments and/or fillers may be milled, for example, in a portion of the aqueous binder. Milling may preferably also take place in a special water-dilutable paste resin. Milling may be carried out in conventional units known to those skilled in the art. The remainder of the aqueous binder or of the aqueous paste resin is then added to produce the finished colouring pigment mill base.

The aqueous base lacquers used in the process according to the invention may contain further additives conventionally employed in lacquers in amounts conventionally employed in lacquers, for example from 0.1 to 5 wt. %, based on their solids content. Examples of such further additives are neutralising agents, antifoams, wetting agents, adhesion-promoting substances, catalysts, flow agents, anti-pitting agents, light stabilisers and thickeners such as, for example, synthetic polymers having groups that are ionic and/or have an associative action, such as polyvinyl alcohol, poly(meth)acrylamide, poly(meth)acrylic acid, polyvinylpyrrolidone, hydrophobically modified ethoxylated polyurethanes or polyacrylates, crosslinked or uncrosslinked polymer microparticles.

The aqueous base lacquers used in the process according to the invention contain organic solvents, the amount of which is such that the aqueous base lacquers have high solid values of from 40 to 70%, for example the aqueous base lacquers contain from 20 to 30 wt. % organic solvents. The composition of the organic solvents in the aqueous base lacquers preferably consists of from 30 to 60 wt. % organic solvents that are low-boiling, for example that boil preferably below 120° C., and that are miscible with water readily or without a miscibility gap, for example that have a water-solubility at 20° C. of more than 70 g per liter of water. Such organic solvents are preferably chosen from methanol, ethanol, n-propanol, isopropanol, n-butanol, 2-butanol, isobutanol, methoxypropanol, methyl ethyl ketone, acetone or mixtures thereof; n- and iso-propanol are particularly preferred.

Examples of further organic solvents that may be contained in the aqueous base lacquers used in the process according to the invention and that may account for preferably from 40 to 70 wt. % of the organic solvent composition in the aqueous base lacquer are monohydric alcohols having 5 or more carbon atoms, for example hexanol; ethylene glycol ethers or esters, for example ethylene glycol dimethyl ether, diethylene glycol mono- or di-C1–C6-alkyl ethers, butyl glycol, butyl diglycol, ethyl glycol acetate, butyl glycol acetate; propylene glycol ethers or esters, for example propylene glycol dimethyl ether, dipropylene glycol mono- or di-C1–C6-alkyl ethers, ethoxypropanol, propoxypropanol, butoxypropanol, methoxypropyl acetate, ethoxypropyl acetate; ethylene glycol, propylene glycol, and their dimers or trimers, N-alkylpyrrolidones, for example N-methylpyrrolidone; ketones, for example cyclohexanone; aromatic or aliphatic hydrocarbons, for example toluene, xylene or linear or branched aliphatic C6–C12-hydrocarbons.

In the process according to the invention, the aqueous base lacquers are applied to motor vehicle bodies that may consist of one type of substrate or of a plurality of types of substrate joined together in a composite construction. In general, the substrates are of metal or plastics. They are generally pre-coated, that is to say plastics substrates may be provided, for example, with a primer coating of plastics, metal substrates generally have a primer coating applied, for example, by electrophoresis and optionally, in addition, one or more further lacquer layers, such as, for example, a primer surfacer layer. The aqueous base lacquers are applied by spraying in one or more spraying operations in a dry layer thickness of from 10 to 50 μm; in the case of aqueous effect base lacquers, the dry layer thickness is, for example, preferably from 10 to 25 μm, and in the case of aqueous single coloured base lacquers it is preferably higher, for example from 15 to 40 μm.

The application of the aqueous base lacquer and the clear lacquer is carried out in the process according to the invention by the known wet-on-wet principle, that is to say the base lacquer layer applied from the aqueous base lacquer coating composition is first pre-dried by exposure to air before the clear lacquer coating is applied. Pre-drying by exposure to air according to the invention is important in order that the finished two-layer coating meets the demands made both of the technological properties, such as, for example, adhesion and resistance to the impact of stones, and of the optical properties, such as, for example, colour shade, the development of special effects, and the appearance.

In addition to the above-mentioned conditions to be observed in the formulation of the aqueous base lacquer coating compositions used in the process according to the invention, it is essential to the invention that, after application of the base lacquer layers produced from the aqueous base lacquer coating compositions and before application of the transparent finishing lacquer layer, the base lacquer layers be exposed to air for from 30 to 180 seconds using circulating air at from 25 to 45° C. with an air throughput of from 0.10 to 0.70 m/s, based on the area provided with the aqueous base lacquer layer.

Exposure to air of the applied aqueous base lacquer layer takes place in the base lacquer air-exposure zone of the motor vehicle series lacquering and lasts for from 30 to 180 seconds, preferably from 60 to 150 seconds. That time is given, for example, by the overall length of the base lacquer air-exposure zone of the motor vehicle series lacquering unit, which is, for example, from 5 to 15 m, and the belt speed of, for example, from 2 to 6 m/min prevailing therein. Exposure to air takes place under circulating-air conditions at air temperatures of from 25 to 45° C., preferably from 30 to 40° C. The circulating-air conditions are so chosen that an air throughput, based on the area coated with aqueous base lacquer, of from 0.10 to 0.70 m/s, preferably from 0.15 to 0.60 m/s, is used. The air throughput, based on the area coated with aqueous base lacquer, is calculated as the quotient of the volume of air, in cubic meters, that passes through the air-exposure zone per second and the area, coated with aqueous base lacquer, that is located in the air-exposure zone and is to be exposed to air, for example of the order of from 20 to 150 square meters. The volume of air that passes through the air-exposure zone in the process according to the invention is, for example, from 1 to 2 cubic meters per meter of air-exposure zone and per second. The area, coated with aqueous base lacquer, that is located in the air-exposure zone and is to be exposed to air is calculated from the number of coated motor vehicle bodies present in the base lacquer air-exposure zone at the same time, for example from 1 to 3 vehicle bodies, and the area, in square meters, of the vehicle body in question that is coated with aqueous base lacquer and is to be exposed to air, for example of the order of magnitude of from 15 to 35 square meters in the motorcar sector or from 20 to 65 square meters in the commercial vehicle sector. The expression "area of an individual vehicle body that is coated with aqueous base lacquer and is to be exposed to air" means not only the area of an individual vehicle body that is subsequently to be provided with a clear lacquer coating, but also includes any portions of the surface that are not to be covered with clear lacquer, for example in the interior space of the vehicle body.

In the process according to the invention, exposure to air is carried out under circulating-air conditions. For example, the procedure is such that the circulating air contains from 5 to 15 g of water per cubic meter. It is also possible for a part, for example from 5 to 20%, preferably from 5 to 10%, of the volume of air passing through the air-exposure zone per second to leave the air-exposure zone as outgoing air and to be replaced by a corresponding amount of fresh air, which is mixed in with the air that is being circulated. The fresh air contains preferably less than 15 g, particularly preferably from 5 to 12 g, of water per cubic meter. The water content of the fresh air that is mixed in may be adjusted by means of conventional dehumidification methods, such as, for example, compression of air and/or condensation or absorption of the water from the air.

The circulating air is expediently moved at a flow rate of from 4 to 8 m/s, measured at the object. It is preferably a turbulent flow of air, which is directed from top to bottom and from the sides onto the vehicle body provided with the base lacquer layer to be exposed to air. The air is expediently guided uniformly and perpendicularly onto the base lacquer layer to be exposed to air. The air is expediently drawn off downwards.

The air-exposure zone may be operated under constant operating conditions or with a variation of individual or several operating parameters. Variation of operating parameters may be carried out in the form of a continual or sudden change over the entire overall length or over one or more portions of the overall length of the air-exposure zone. The air-exposure zone may be divided into one or more, for example from 1 to 3, zones, which may be separated from one another by locks. However, the variation in the operating parameters during the exposure to air always lies within the limits laid down by the invention for the air-exposure operation seen as a whole. For example, it is possible for the air-exposure zone to be divided into 2 zones, the vehicle bodies coated with aqueous base lacquer being exposed to air first in the first zone at low air temperatures, for example from 25 to 30° C., and then in the second zone at higher air temperatures, for example from 30 to 45° C.; the air throughput in the two zones may, for example, be chosen to be the same or different, for example lower in the first zone than in the second; for example, the flow rate of the circulating air measured at the object may be above 8 m/s in the second zone. When considering the air-exposure zone or the air-exposure operation as a whole, however, the average air throughput lies within the limits specified by the invention.

The aqueous base lacquer layers pre-dried by exposure to air are covered with a conventional chemically crosslinking clear lacquer in a dry layer thickness of, for example, from 30 to 100 μm and baked together therewith at temperatures of, for example, from 100 to 150° C. An advantage of the process according to the invention arises from the low air temperatures prevailing during exposure to air of the aqueous base lacquer layers. It is thus possible for the base lacquer layers that have been exposed to air to be covered with a clear lacquer without prior cooling of the vehicle bodies. Suitable clear lacquers are in principle all known clear lacquers or transparent pigmented coating compositions. It is possible to use either solvent-containing single-component (1K) or two-component (2K) clear lacquers, water-dilutable 1K or 2K clear lacquers, powder clear lacquers or aqueous powder clear lacquer slurries. The baking conditions for the two-layer coating consisting of the aqueous base lacquer and the clear lacquer are dependent on the clear lacquer system that is used.

The process according to the invention makes it possible to produce two-layer motor vehicle top coats consisting of an aqueous base lacquer layer and a clear lacquer finishing layer by the wet-on-wet process while allowing only short air-exposure times of from 30 to 180 seconds for the base lacquer layer. By means of the process according to the invention it is possible to process aqueous base lacquers in automated motor vehicle series lacquering units that are themselves designed for the processing of non-aqueous base lacquers and allow only short air-exposure times for the base lacquer layers. The complex conversion of such lacquering units that are themselves unsuitable for the processing of aqueous base lacquers can be avoided. Provided that the conditions that are essential to the invention are observed during the formulation of the aqueous base lacquers and the air-exposure conditions for the aqueous base lacquer layers that are essential to the invention are observed, it is even possible to carry out the process according to the invention in such a manner that both the aqueous base lacquers and non-aqueous base lacquers are processed in a motor vehicle series lacquering unit.

EXAMPLE

A motorcar body is coated in a lacquering cubicle for test purposes:

A 4.3 m long motorcar body primed with cathodic electro coating and provided with a primer surfacer layer is coated in a dry layer thickness of 15 $\mu$m with a silver-coloured aqueous base lacquer (composition: solids content 20 wt. %, dimethylethanolamine 1 wt. %, butyl glycol 8.5 wt. %, N-methylpyrrolidone 2 wt. %, water 59 wt. %, n-propanol 7 wt. %, n-butanol 2.5 wt. %, high solid value: 50%; pigment/binder ratio: 0.2:1). The coated area is approximately 20 square meters. Exposure to air is then carried out in a 5 m long air-exposure zone for 90 s using circulating air (water content 12 g per cubic meter) at 40° C. The circulating-air output is 1.5 cubic meters per second and per meter of air-exposure zone. After the exposure to air, the coating is covered with a conventional two-component clear lacquer in a dry layer thickness of 35 pm and baked for 30 minutes at 135° C. (object temperature).

The resulting coating is boiler-free and also meets the other technological demands made of a modern automotive coating.

What is claimed is:

1. A process for producing a two-layer coat on a motor vehicle body in an automatic motor vehicle series lacquering unit, comprising:

(a) applying an aqueous base lacquer coating composition to said motor vehicle body, wherein said aqueous base lacquer coating composition comprises one or more organic solvents and has a high solid value of 40 to 70%;

(b) exposing said aqueous base lacquer coating to a circulating air at 25 to 45° C. having an air throughput of 0.10 to 0.70 m/s for 30 to 180 seconds;

(c) applying a transparent finishing lacquer layer of a clear lacquer coating composition to said aqueous base lacquer layer; and (d) baking said aqueous base lacquer and said transparent finishing lacquer layer;

wherein the resultant coating is boiler-free.

2. The process according to claim 1 wherein the aqueous base lacquer coating composition comprises 20 to 30 wt. % organic solvents.

3. The process according to claim 1, wherein the organic solvents comprise 30 to 60 wt. %, based on the total solvents content, low-boiling organic solvents that are miscible with water readily or without a miscibility gap.

4. The process according to claim 2, wherein the organic solvents comprise 30 to 60 wt. %, based on the total solvents content, low-boiling organic solvents that are miscible with water readily or without a miscibility gap.

5. The process according to claim 1 wherein said (b) exposing said aqueous base lacquer coating to a circulating air occurs in at least one air-exposure zone.

6. The process according to claim 5 wherein said (b) exposing said aqueous base lacquer coating to a circulating air occurs in 1 to 3 air-exposure zones.

* * * * *

UNITED STATES PATENT AND TRADEMARK OFFICE

CERTIFICATE OF CORRECTION

PATENT NO. : 6,548,119 B1 
DATED : April 15, 2003
INVENTOR(S) : Ludwig Siever et al.

It is certified that error appears in the above-identified patent and that said Letters Patent is hereby corrected as shown below:

Column 7,
Line 38, the abbreviation "pm" should read -- μm --.

Signed and Sealed this

Second Day of September, 2003

JAMES E. ROGAN
*Director of the United States Patent and Trademark Office*